United States Patent [19]

Linetsky

[11] 4,207,042

[45] Jun. 10, 1980

[54] CASTING AND ERECTING MACHINE

[76] Inventor: Mikhail Linetsky, #94-276 Adsum Dr., Winnipeg, Manitoba, Canada, R2P 0W2

[21] Appl. No.: 7,653

[22] Filed: Jan. 29, 1979

[51] Int. Cl.[2] ..... B28B 1/00

[52] U.S. Cl. ..... 425/62; 425/63

[58] Field of Search ..... 425/62, 63, 88, 453, 425/454; 249/1, 20, 26, 27, 160, 170, 171, 172, 188, 207, 209, 210, 212, 184, 186, 83

[56] References Cited

U.S. PATENT DOCUMENTS

| | | | |
|---|---|---|---|
| 934,768 | 9/1909 | Talbot | 425/63 X |
| 1,134,543 | 4/1915 | McArthur | 425/63 |
| 1,563,798 | 12/1925 | Sargeant | 425/63 |
| 1,596,868 | 8/1926 | Brynoldt | 425/62 |
| 2,870,518 | 1/1959 | Bossner | 425/63 |
| 2,989,607 | 11/1949 | Alexander | 249/171 X |
| 3,234,620 | 2/1966 | Short | 425/62 |
| 3,320,646 | 5/1967 | Wilkins | 425/62 |
| 3,659,977 | 5/1972 | Haws | 425/63 X |
| 3,724,805 | 4/1973 | Kleiber et al. | 249/171 |
| 3,847,341 | 11/1974 | Strikler | 249/27 |
| 3,847,521 | 11/1974 | Strikler | 249/27 X |

*Primary Examiner*—J. Howard Flint, Jr.

[57] ABSTRACT

A machine for horizontal casting of concrete wall panels and slabs and for assembling them together to form room units or single-story buildings.

The machine includes a wheeled frame, movable along a rail-track; two form-erectors, rotatable parallel to the rail-track; two form-strippers, rotatable across the track, and a lifting mould. All edges on the form-erectors and form-strippers are detachable and must be taken away before rotating.

When used at the plant, the machine erects the room units on two trailers (one on each side of a casting station). A typical technological cycle starts with erecting a cross wall panel on an incomplete room unit. For this purpose the form-stripper rotates into vertical position, the machine moves close to the room unit, and the panel is released with a bottom hinged lock bracket. After the panel is fixed, the room unit, having been on the trailer, is ready for transportation to the job site.

Then the machine moves back to another trailer and erects the next room unit in the following order: the form-erectors install the longitudinal wall panels with the aid of two top brackets; the lifting mould moves down and puts the slab down on the wall panels thereby stripping itself. Another form-stripper installs a cross wall panel.

The machine can also be successfully used on the construction site, especially during the flow-building of houses, erecting panels straight on foundations, situated along a rail-track.

The present machine can erect room units and buildings with different lengths for various structures.

2 Claims, 5 Drawing Figures

CASTING AND ERECTING MACHINE

BRIEF SUMMARY OF THE INVENTION

This invention relates to molding systems utilized in precast concrete industry and construction.

Existing methods of producing precast concrete assemblyline room units or boxes require cranes for stripping and assembling wall panels and slabs, for loading the room units on transportation facilities and for erecting precast members on the construction site.

The necessity of using numerous cranes raises the cost of precast structures and buildings considerably and prevents their wide use, especially in housing.

It is a primary object of the invention to produce insulated or non-insulated wall panels and slabs and to erect them together without using cranes to form either a room unit, loaded on a trailer at the plant; or a building, set up on the job site.

This problem is solved by making a movable machine, having a rotatable form with erecting ability on each of four sides, and a lifting mould.

A better understanding of the present invention may be had from the following detailed description when read in conjunction with the accompanying drawings.

DETAILED DESCRIPTION OF THE INVENTION

Figure 1:
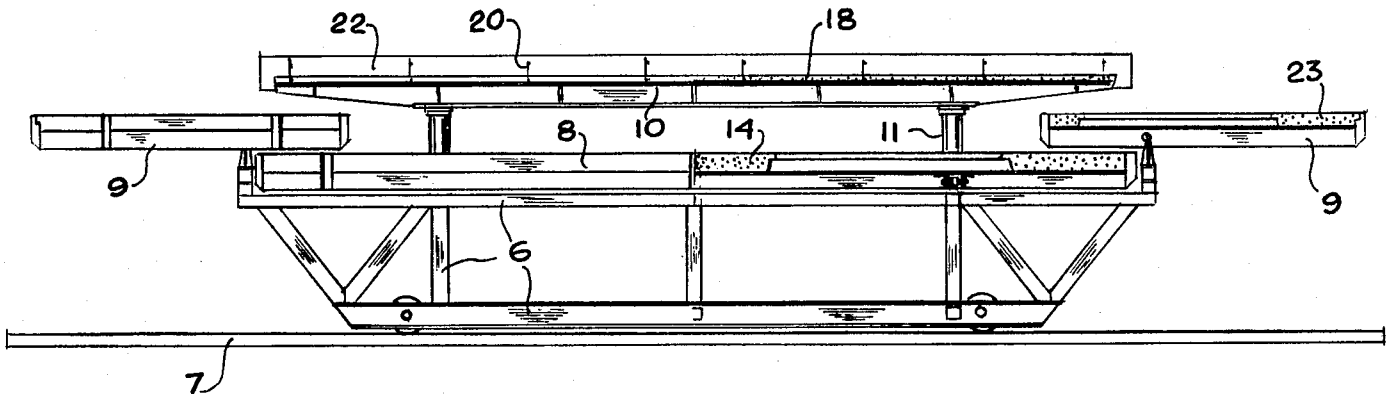
FIG. 1—is a view of the machine before erecting, partly in front elevation and partly in longitudinal section.

Before explaining the disclosed embodiment of the present invention in detail, it is bo be understood that the description and drawings do not touch upon any known methods of the processing technology, which should be used for casting and curing panels, any known or minor machinery parts and means for rotating the form-erectors and form-strippers, for lifting the mould and for moving the machine. Also, the terminology used herein is for the purpose of description and not of limitation.

Since the design of each pair of the form-erectors and form-strippers is similar, they and their parts are designated by the same reference numerals.

Referring now to the drawings, the present machine consists of a wheeled frame 6, movable along a rail-track 7 and supporting two form-erectors 8, rotatable parallel to the rail-track 7; two form-strippers 9, rotatable across the rail-track 7; and a lifting mould 10 through two jacks 11, as is best shown in drawing FIG. 1.

Figure 2:
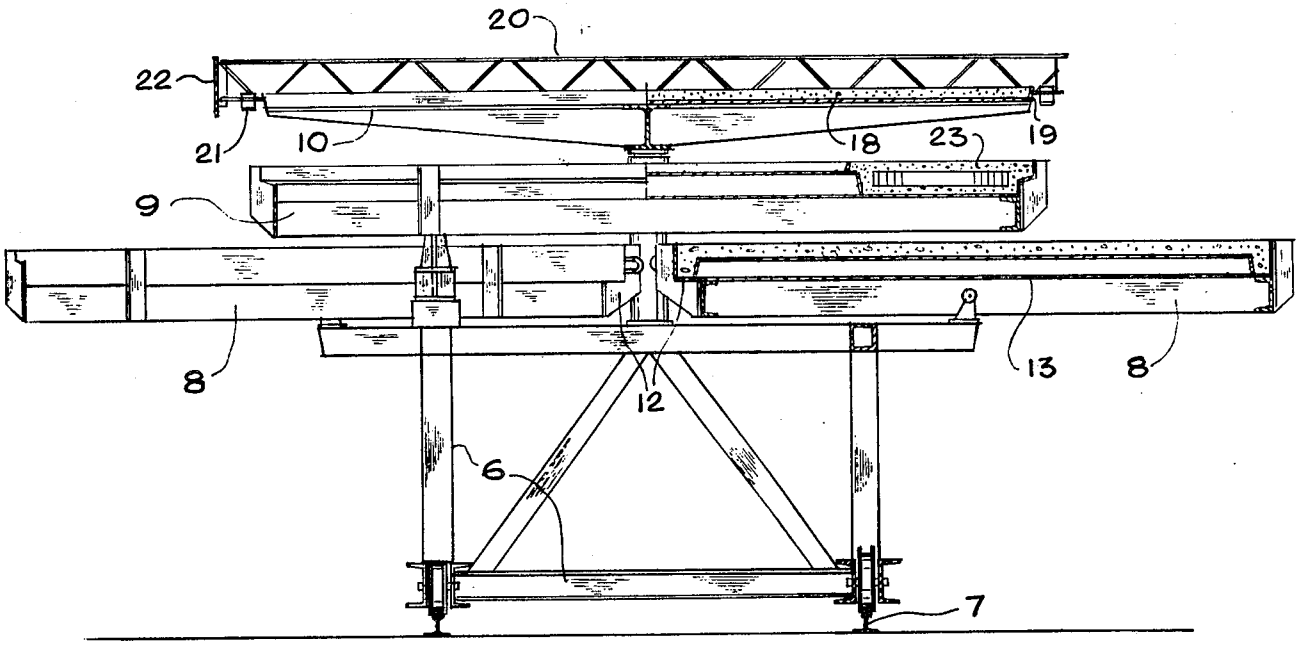
FIG. 2—is a view of the machine before erecting, partly in back elevation and partly in cross section.

Before erecting the panels, all edges on the form-erectors and form-strippers are taken away. They can be of any known detachable design, except an edge 12 (FIG. 2) on each form-erector, which would have become the top edge after rotating. In accordance with an important aspect of the present invention, this edge has an angle profile with one side being a continuation of a pan 13.

Figure 3:
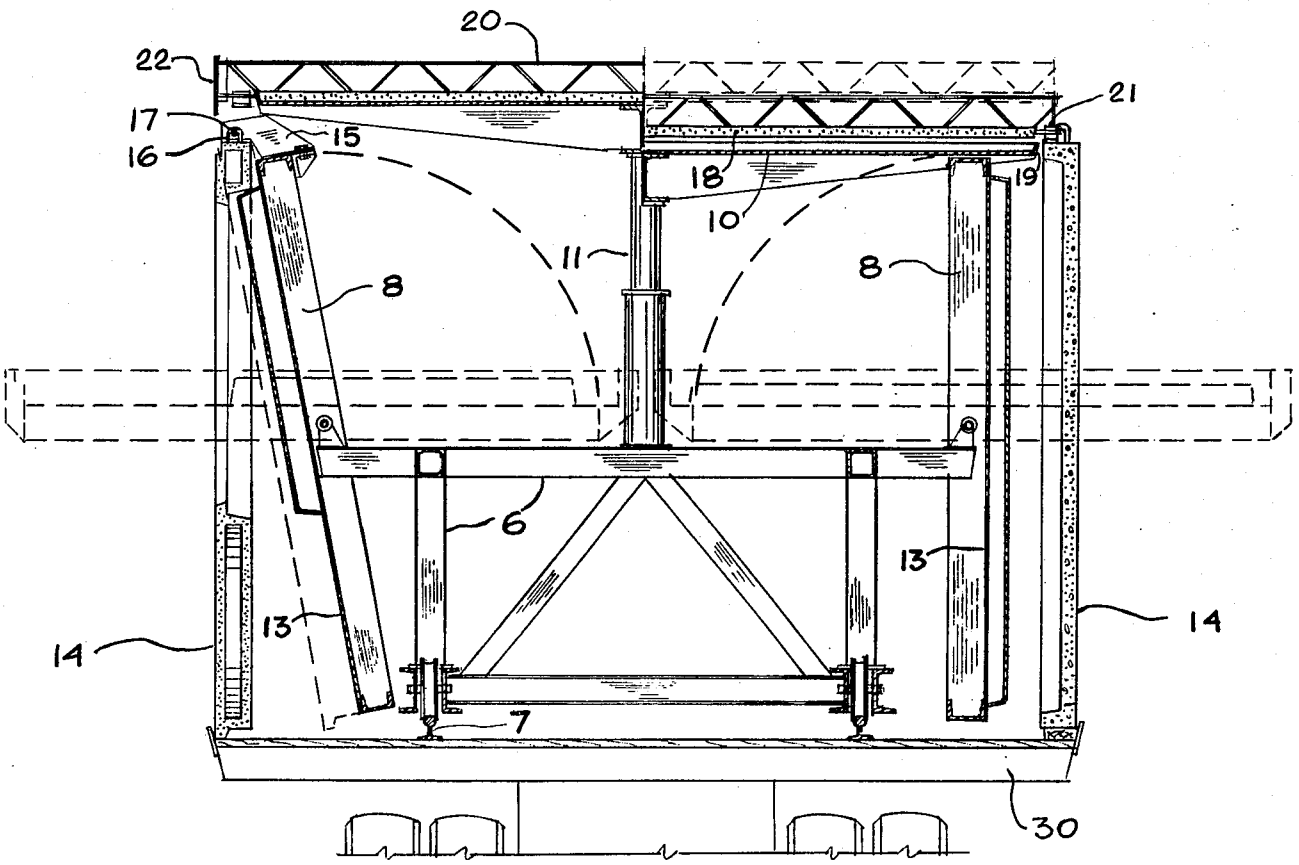
FIG. 3—is a cross-sectional view of the machine, partly showing erection of the left wall panel and partly showing the slab put down on the installed right wall panel. The starting position of the form-erectors is shown with dotted lines.

Erection of a room unit or a building starts from longitudinal bearing wall panels 14 with the form-erectors 8. Following this, the edge 12 is replaced by two brackets 15 (FIG. 3). Each of them is fixed to a loop 16 with bolt 17. Then the form-erectors are rotated more than 90°, the panels 14 are stripped, hung on the bolt 17, and installed by rotating the form-erectors, and the bolts 17 and the brackets 15 are taken away. After the mould 10 puts a slab 18 down on the wall panels 14, the form-erectors 8 remain in the vertical position.

To ensure the prompt stripping of the slab 18 and the minimum height of a room for the stripped mould 10, the latter has low solid sloped edges 19, and the width of the mould 10 is less than the clear distance between the wall panels 14.

Figure 4:
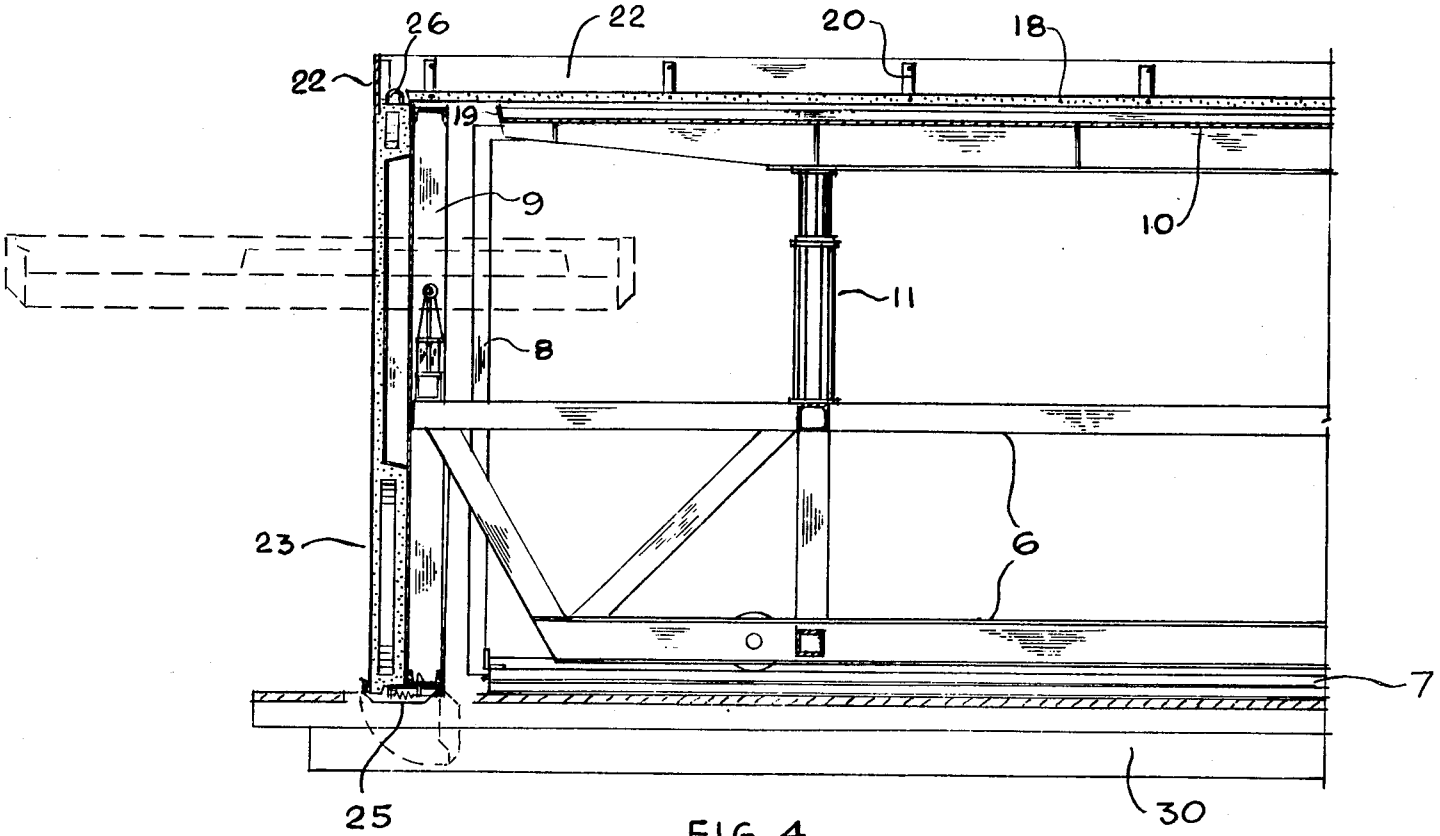
FIG. 4—is a partial end view of the machine, showing a form-stripper at the moment of erecting a wall panel. The starting position of the form-stripper is shown with dotted lines.

Since the slab 18 is rather thin, it is supported by reinforcing cages 20, which have bearing parts 21 outside the mould 10. The cages 20 can also support freeze boards 22 to complete the slab 18 later. After the slab 18 is put down on the wall panels 14, the machine erects a cross wall panel 23 with the form-stripper 9 (FIG. 4).

To follow this, an edge 24 (FIG. 1), which would have become the bottom edge after rotating, is replaced by a hinged lock bracket 25 (FIG. 4), and loops 26 are fastened to the form-stripper. Then the form-stripper is rotated into the vertical position, the machine is removed as much as necessary to fix the panel 23 to the panels 14, and the panel 23 is released with the bracket 25.

To make the machine capable of moving inside the room unit, the length of the form-strippers without edges and the length of the cross wall panels is less than the clear distance between installed longitudinal wall panels.

The second cross wall panel should be erected on a room unit or a building, situated on the opposite side of the rail-track the same way as the first one.

After having erected all panels, the machine returns to a casting station, the form-erectors and form-strippers are consecutively rotated back into the horizontal position and poured with concrete, and the mould is lowered and poured as well.

Figure 5:
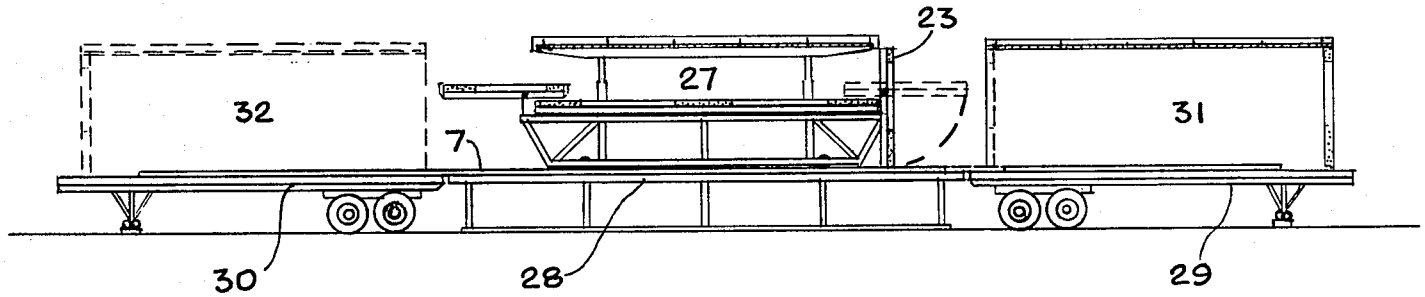
FIG. 5—is a longitudinal sectional view of the machine, starting a typical technological cycle at the plant. The panels and the slab, which will have been erected during the cycle, are shown with dotted lines.

Shown in FIG. 5 is the present machine, generally designated as 27, operating at the plant. The rail-track 7 connects a casting station 28 with two trailers 29 and 30.

By the start of a typical technological cycle, an incomplete room unit 31 is on the trailer 29. First the machine erects the cross wall panel 23 on the room unit 31. After the panel 23 is fixed, the room unit 31 is ready for transportation to the job site on the trailer 29.

Then the machine moves to the trailer 30 and erects there the next room unit 32. The missing cross wall panel of the room unit 32 should be installed right from the start of the next technological cycle.

I claim:

1. A machine for horizontal casting and erecting concrete wall panels and slabs to form room units or single-storey buildings, comprising:

a rail-track;

a wheeled frame, movable along said rail-track;

two form-erectors for casting and erecting longitudinal bearing wall panels, each supported by said frame and rotatable more than 90° parallel to the rail-track;

two form-strippers for casting and erecting cross wall panels, each supported by the frame and rotatable 90° across the rail-track; the length of each form-stripper without edges and of a cross panel is less than the clear distance between installed longitudinal wall panels;

a lifting mould with a low solid sloped edges for casting thin slabs with reinforcing cages; said mould is supported by said frame through two jacks; the width of said mould is less than the clear distance between installed longitudinal bearing wall panels and the length of said cages;

a detachable edge on each form-erector, which would have become the top edge after rotating; said edge has an angle profile, one side of which is a continuation of a pan, and creates a room for the stripped lifting mould;

two brackets on each form-erector, which replace said edge; said brackets are fixed with loops of the wall panel and hold it during erecting;

a hinged lock bracket on each form-stripper; said bracket replaces an edge, which would have become the bottom edge after rotating, and releases the panel to be fixed to the previously installed longitudinal wall panels.

a technological cycle, starting from erecting a cross wall panel on an incomplete room unit or a building and continuing on the opposite side of the rail-track.

2. A machine as claimed in claim 1, wherein: said rail-track connects a casting station with two trailers.

* * * * *